US005205554A

United States Patent [19]

Copson

[11] Patent Number: 5,205,554

[45] Date of Patent: Apr. 27, 1993

[54] INTERSECTING RACE TRACK WITH OBSTRUCTING MEANS TO PROMOTE COLLISIONS

[76] Inventor: Alexander G. Copson, 3419 Dent Pl., NW., Washington, D.C. 20007

[21] Appl. No.: 541,319

[22] Filed: Jun. 21, 1990

[51] Int. Cl.[5] ..... A63F 9/14

[52] U.S. Cl. ..... 273/86 R; 446/444; 104/60

[58] Field of Search ..... 273/85 R, 86 R; 446/444, 445, 446; 104/60, 140, 141; 235/93, 99

[56] References Cited

U.S. PATENT DOCUMENTS 3,205,833 9/1965 Fitzpatrick ..... 104/60

3,402,503 9/1968 Glass et al. ..... 104/60

OTHER PUBLICATIONS

"Faller Auto Motor Sport Catalogue" Germany 1967, pp. 10, 11 and 39.

*Primary Examiner*—V. Millin

*Assistant Examiner*—William M. Pierce

*Attorney, Agent, or Firm*—William E. Mouzavires

[57] ABSTRACT

A toy car racing board game having two continuous car tracks which have serpentine portions and cross each other at several points. Except for the crossing points, the tracks are hidden by walls on their opposite sides. Each player electrically controls a car with the object of completing one or more passes around its track or to prevent the other car from completing a pass by colliding with it at any of the intersections.

6 Claims, 1 Drawing Sheet

INTERSECTING RACE TRACK WITH OBSTRUCTING MEANS TO PROMOTE COLLISIONS

OBJECTS AND SUMMARY OF INVENTION

The present invention generally relates to toy car racing games and more specifically to a novel board game utilizing electrically driven toy cars movable on tracks under the control of the player.

An object of the present invention is to provide a novel toy car racing game that will provide fun, excitement and amusement to the players. Included herein is such a game that may be played on a game board placed on the table or other surface within the home without consuming any great space.

A further object of the present invention is to provide such a game that may utilize conventional tracks and electrically driven toy cars and controls for the cars and in other respects may be manufactured with readily available materials.

In summary, a preferred embodiment of the game of the present invention, includes a game board having at least two distinct tracks which are both continuous and include serpentine portions which cross each other at several intersections along the tracks. Except for the intersections, the tracks and the cars on the tracks are hidden from view as they move along the tracks under the control of the players. Each player is assigned a car and a track, and the object is to prevent the other player from making one or more complete passes around the track by colliding the cars at the intersections. Any suitable electrical system may be employed for motorizing the cars and tracks.

DRAWINGS

Other objects and advantages of the present invention will become apparent from the following more detailed description taken in conjunction with the drawings in which:

FIG. 1 is a plan view of a game board embodying the invention and including two toy cars on tracks incorporated in the game board; and FIG. 2 is a fragmental cross-sectional view taken generally along lines 2—2 of FIG. 1; and FIG. 3 is a fragmental cross-sectional view taken generally along lines 3—3 of FIG. 1.

DETAILED DESCRIPTION

Figure 1:
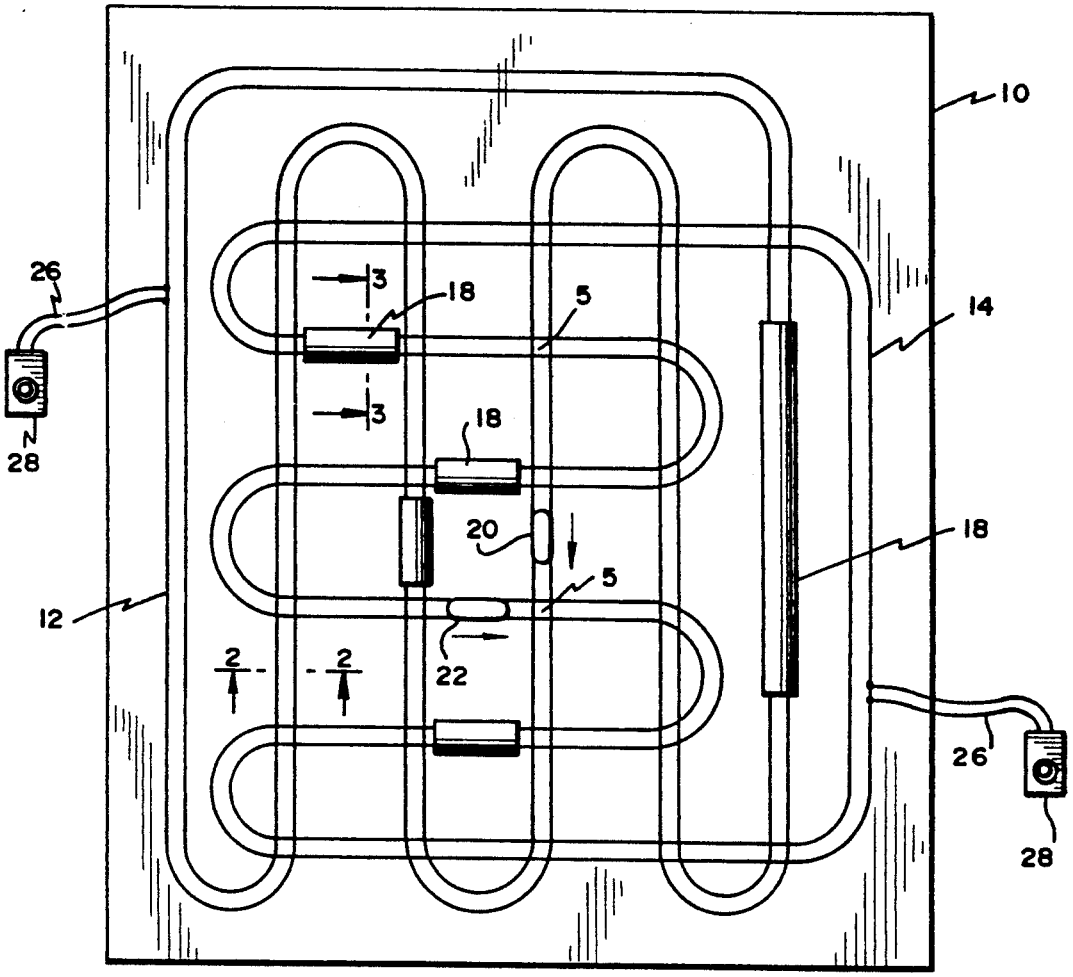

Referring to the drawings in detail there is shown for illustrative purposes only a preferred embodiment of the present invention including a game board generally designated 10 made from any suitable material such as wood, metal or plastic and being for example three feet by three feet in planar dimension. As shown in FIG. 1, a plurality of intersecting continuous tracks 12 and 14 are fixed on the board 10 to receive electrically motorized toy cars 20 and 22. The cars are conventional in their construction and have electrical contacts engageable with the conductive tracks 12 and 14 to energize motors in the cars 20 and 22 to move the cars along the tracks when current is sent to the tracks through leads 26 under the control of the players operating the controls 28. Since, the cars, tracks and controls are well-known in their construction further description of them is not believed to be necessary.

Figure 2:
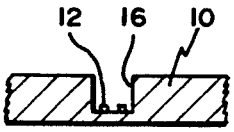
Figure 3:
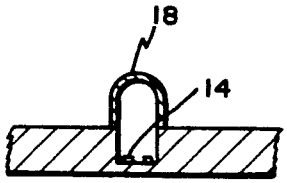

In accordance with the invention, tracks 12 and 14 cross each other at a plurality of locations or intersections 5 and moreover each have portions which are partially or fully covered so as to conceal or obstruct view to the cars when passing through those portions. In the preferred embodiment, several or all of the intersections 5 are not obstructed or concealed from view for a purpose to be described below. This is effected by raising the elevation of the track at the intersection 5 or by relieving the board 10 around each intersection. In the preferred embodiment the tracks are partially concealed by being embedded in the board 10 below the surface thereof as shown in FIGS. 2 and 3. In an alternative embodiment not shown, rather than being embedded, the tracks may be on the surface of the board with walls formed along opposite sides of the tracks except at the intersections 5. In addition, in the preferred embodiment portions of the tracks are completely concealed from view by providing tunnels, bridges or similar eye barriers shown as 18 overlying portions of the tracks as shown for example in FIGS. 1 and 3. Although not shown the board 10 may be provided with contours and other shapes and objects to represent various terrain such as hills or valleys or houses etc.

In playing the game, each player attempts to prevent the other player from moving his car 20 or 22 one or more complete passes around the assigned track 12 or 14. This is done by colliding the player's car with the other player's car at any one of the intersections 5. The concealment or partial concealment of portions of the tracks 12, 14 allows each player to conceal his or her car and surprise the other player at an intersection. The walls 16 of the board 10 on opposite sides of the tracks 12, 14 also serve to maintain the cars on the tracks 12, 14 particularly at the turns. However the intersections 5 are not embedded or walled in so that if a car is struck by another car as is the purpose of the game, the car will be dislodged from the track. The dislodged cars are then returned to the board and the game is continued in the same manner.

In addition to concealing portions of the track by walls 16 and tunnels 18, obstacles (not shown) to sight may also be placed on the board at stragegic locations so that a player may hide his or her car behind the obstacle with the goal of surprising the opponent's car at an intersection.

Although in one preferred embodiment the tracks 12, 14 each have a serpentine shape in plan view, other shapes may be employed as long as each of the tracks 12, 14 are independent and intersect each other preferably at more than one location. Moreover it is preferred that each of the tracks be continuous. It will be apparent that various game rules may be used or adapted in keeping with the central theme of the game and without departing from the scope of the invention which is indicated in the claims to follow:

I claim:

1. A toy car racing game wherein electrically driven cars are moved along tracks, the game including a game board having at least two independent and distinct tracks intersecting each other at least at one intersection, and means along the tracks and spaced from said intersection for obstructing portions of the tracks from view and for maintaining toy cars on the tracks except at said intersection.

2. The game defined in claim 1 wherein said means includes barriers overlying portions of the tracks respectively.

3. The game defined in claim 1 wherein said means includes walls on opposite sides of portions of each of the tracks.

4. The game defined in claim 1 wherein each track has a serpentine shape and intersects the other track at several intersections.

5. The game defined in claim 1 wherein said tracks are each continuous.

6. Toy car racing game apparatus including means forming at least a pair of endless tracks intersecting each other at least one intersection, said tracks being adapted to receive toy cars to be moved along said tracks with the object of sticking another such car at said intersection, said means including opposed walls on opposite sides of the tracks concealing portions of the tracks from view and for preventing removal of the toy cars from the tracks except at said intersection during operation such that toy cars colliding at the intersection may be dislodged from the tracks at the intersection, said opposed walls are closely adjacent the tracks to prevent lateral movement of toy cars off the tracks, said tracks including curved portions and wherein said toy cars are prevented by said walls from moving off the curved portions of the tracks by centrifugal forces during operation.

* * * * *